United States Patent [19]

Bangs

[11] Patent Number: 4,533,569

[45] Date of Patent: Aug. 6, 1985

[54] PROCESS PREVENTING AIR BUBBLE LOCK IN INK JET NOZZLES

[75] Inventor: Richard G. Bangs, Ithaca, N.Y.

[73] Assignee: NCR Corporation, Dayton, Ohio

[21] Appl. No.: 559,510

[22] Filed: Dec. 8, 1983

[51] Int. Cl.[3] ..... B05D 3/10; B05D 5/00; B05D 7/22

[52] U.S. Cl. ..... 427/154; 427/230; 427/309

[58] Field of Search ..... 427/299, 307, 309, 154, 427/165, 444, 230; 65/60.1, 60.3; 29/157 C; 106/13; 346/140 R, 140 PD

[56] References Cited

U.S. PATENT DOCUMENTS

| | | | |
|---|---|---|---|
| 2,292,097 | 8/1942 | Vollmer | 106/13 |
| 3,573,950 | 4/1971 | Domicone | 427/299 |
| 4,343,013 | 8/1982 | Bader et al. | 346/140 PD |

FOREIGN PATENT DOCUMENTS

| | | | |
|---|---|---|---|
| 2455019 | 7/1975 | Fed. Rep. of Germany | 346/140 PD |

OTHER PUBLICATIONS

Xerox Disclosure Journal, vol. 7, No. 5, Sep./Oct., 1982, p. 321.

*Primary Examiner*—Evan K. Lawrence

*Attorney, Agent, or Firm*—J. T. Cavender; Stephen F. Jewett; Robert L. Clark

[57] ABSTRACT

A process for treating the interior surface area of a glass nozzle for use in an ink jet printer device. The process includes cleaning of the surface area with a hydrofluoric acid solution under controlled conditions, rinsing and then protecting the cleaned area with a blocking agent to prevent contamination by the atmosphere prior to use of the nozzle in a printer device. The disclosed process is useful in minimizing air bubble formation and lock within the nozzle during use, and in facilitating ejection or purging of such air bubbles as may become ingested by the nozzle during service.

8 Claims, 6 Drawing Figures

PROCESS PREVENTING AIR BUBBLE LOCK IN INK JET NOZZLES

BACKGROUND OF THE INVENTION

This invention relates to ink jet printer devices, and more particularly to the surface treatment of nozzles which are employed in such devices to conduct and eject small droplets of ink for deposit upon record media.

Various types of materials, including glass, are commonly used to form the nozzles for ink jet printer devices. One such material is "Pyrex" glass, which is essentially a glass which contains oxide of boron and has a resultant improved resistance to heat.

Typical glass nozzle configurations are commonly formed using small diameter tube stock, such as 0.020 inch (0.5 mm) I.D. by 0.028 inch O.D. (0.7 mm) tube stock. Forming can be accomplished by heating the glass tube stock and drawing it down at one end to provide a nozzle orifice with a typical diameter of about 2.5–3 mils (0.064 to 0.076 mm). The manner in which such nozzles are made and used is well known in the art.

It has become apparent that the performance of glass nozzles becomes degraded in ink jet printer systems due to the formation and retention of air bubbles within the nozzle conduit. In some cases it has been observed that such air bubbles will adhere to the interior surface area of the nozzle with sufficient tenacity to be immune to substantial efforts to purge them. The presence of air bubbles is a particular problem in drop-on-demand type systems, or systems which operate in a "burst" type mode, where the air bubbles can cause drop velocity and trajectory to significantly vary.

Air bubbles may become present in an ink jet printer system by nucleation of gas entrained in the ink during operation, or by mechanism of ingestion through the nozzle orifice. For example, when an inkfilled nozzle is positioned in a horizontal manner, there is a possibility of air ingestion where the nozzle is physically accelerated, as where the nozzle is moved for printing at different locations with respect to the record media.

Once air bubbles have become present within the ink jet nozzle, it may take varying degrees of effort to remove or purge them from the system. The bubbles have been seen to adhere or "lock" onto the interior surface areas of glass nozzles so tightly that the bubbles remain within the system even as test liquid is forced through the nozzle and ejected through the nozzle orifice as a steady stream.

The small inside geometries of typical glass ink jet nozzles apparently relate nozzle performance to molecular phenomenon. It has been found that the problems of air bubbles in glass ink jet nozzles are a function of wetting properties of the glass interior surface areas or conduit surfaces inside the nozzle. These wetting properties are affected and determined by the presence of impurities and contaminants on the glass surface areas which are involved. Glass which is clean and smooth will be wettable by the ink and not particularly susceptible to adhesion by air bubbles. In contrast, a contaminated glass surface will not be readily wetted by the ink and will provide nucleation points about which air bubbles may form and adhere.

Glass in general is very susceptible to contamination by atmospheric impurities such as dust and other organic and inorganic compounds. Within a short period of time, such as a period of a few minutes, a clean glass surface can become materially contaminated by exposure to the atmosphere. If the surface is the interior surface of a glass ink jet nozzle, the result of the contamination can be a surface area where there is incomplete wetting by the ink, and where air bubbles may form and become attached. An ink jet printer device may thus suffer poor performance due to atmospheric contamination of its glass components.

SUMMARY OF THE INVENTION

This invention provides a special process of surface treatment for glass ink jet nozzles for use in ink jet printer devices. The process treats the interior surface areas of a glass nozzle so as to render the areas wettable by inks and minimize the number of nucleation points at which air bubbles may form and adhere or lock when the nozzle is used in an ink jet printer device.

The process of this invention entails a number of steps. The first step is to clean the glass surface area involved using a hydrofluoric acid solution, so as to remove impurities and contaminants. Preferably, exposure time and strength of the acid solution will be controlled to prevent excessive etching of the glass by the acid, while at the same time effectively removing all contaminants.

Following the cleaning step, the next step is to remove the acid solution from the cleaned surface area, preferably using distilled water to effect the rinsing.

To protect against atmospheric contamination prior to use of the nozzle in an ink jet printer device, the cleaned area is covered or coated with a suitable blocking agent while the nozzle is stored. The blocking agent should be miscible and chemically compatible with ink jet inks, and should have low volatility if the nozzle is to be stored in environments with gaseous phases present. Suitable blocking agents include ethylene glycol, glycerine (glycerol) and distilled degassed water. Ethylene glycol or glycerine may be used neat or in aqueous solution. For example, aqueous solutions containing 75%–90% ethylene glycol by weight are suitable blocking agents. An aqueous solution containing 85% ethylene glycol is presently preferred for its similarity to the base composition used in a wide number of inks for ink jet printing. Under 100% relative humidity storage conditions, as where the storage environment is a liquid phase, degassed distilled water may be a suitable blocking agent to use. The primary requirement is to prevent air from reaching the cleaned glass surface before the nozzle is put into service.

One object of this invention is to provide a process to clean interior surface areas of glass ink jet nozzles for use in ink jet printer devices, to remove impurities and contamination from those surface areas.

Another object of this invention is to provide a treatment for surface areas inside glass ink jet nozzles, to render the surface areas wettable by ink jet inks when the nozzles are in service.

It is also an object of this invention to prevent contamination of cleaned surface areas inside glass ink jet nozzles prior to service of the nozzles in ink jet printer devices.

A further object of this invention is to provide a means of safe storage of cleaned glass ink jet nozzles before service in ink jet printer devices, so that interior surface areas within the nozzles are not contaminated by atmosphere during storage.

Another object of this invention is to minimize nucleation points inside ink jet nozzles which are made of glass, to reduce sites for formation of air bubbles from gas entrained in the ink jet ink during use of the nozzles in ink jet printer devices.

An additional object of the invention is to provide and maintain desired wetting properties of the surface areas inside glass ink jet nozzles, to prevent adhesion to those areas by air bubbles formed within or ingested by the nozzles during printer device operation.

DESCRIPTION OF EXEMPLARY AND PRESENTLY-PREFERRED EMBODIMENTS

Figure 1:
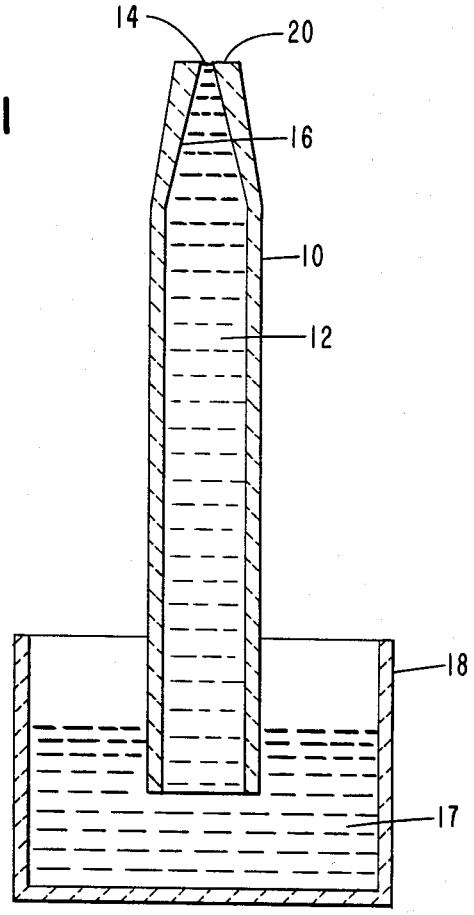
FIG. 1 shows a full sectional view of a glass ink jet nozzle filled with a hydrofluoric acid cleaning solution drawn from a beaker by capillary action.

A typical glass ink jet nozzle configuration 10 as addressed by this invention is illustrated in FIG. 1. The nozzle 10 has a generally tubular shape which defines an interior conduit or channel 12, and the nozzle 10 has been drawn down at one end to provide an orifice 14. During service of the nozzle 10 in an ink jet printer device, ink jet ink will be conducted through the channel 12 and ejected through the orifice 14 as small droplets for deposit upon record media.

In an example of a presently preferred process which embodies this invention, the nozzle 10 is made of "Pyrex" glass and the first step of the process is to clean the interior surface area 16 of the nozzle 10 using a hydrofluoric acid solution. Other acids and other cleaning compositions have been tried, but were found either to insufficiently clean the glass or to overly react with or etch the glass surfaces. For purposes of the invention, the object of the cleaning step is to remove impurities and contaminants from the target surface area and thereby render the area wettable by ink jet inks.

In accordance with this invention, the cleaning step can be carried out by simple exposure of the target surface area to the hydrofluoric acid solution for a period of time. The material parameters of the step are thus the strength or concentration of the acid and the period of exposure time which is allowed. Where the inside diameter of the nozzle 10 is small, e.g. 20 mils (0.5 mm), the acid cleaning solution may be introduced within the nozzle 10 by mechanism of capillarity as shown in FIG. 1. This may be done by dipping the end of the nozzle 10 opposite the nozzle orifice 14 into the acid cleaning solution 17 contained in a beaker 18, while maintaining the nozzle 10 in a vertical position as shown.

While the cleaning process may normally remove or etch a small amount or molecular layer of glass from the target surface area, it is desirable that appreciable or excessive etching be avoided, i.e. etching which is visible to the naked eye. Thus, it is preferred that the combined effects of acid strength and exposure time be sufficient to effect an adequate cleaning, and yet so controlled as to avoid visibly etching the exposed glass.

Figure 2:
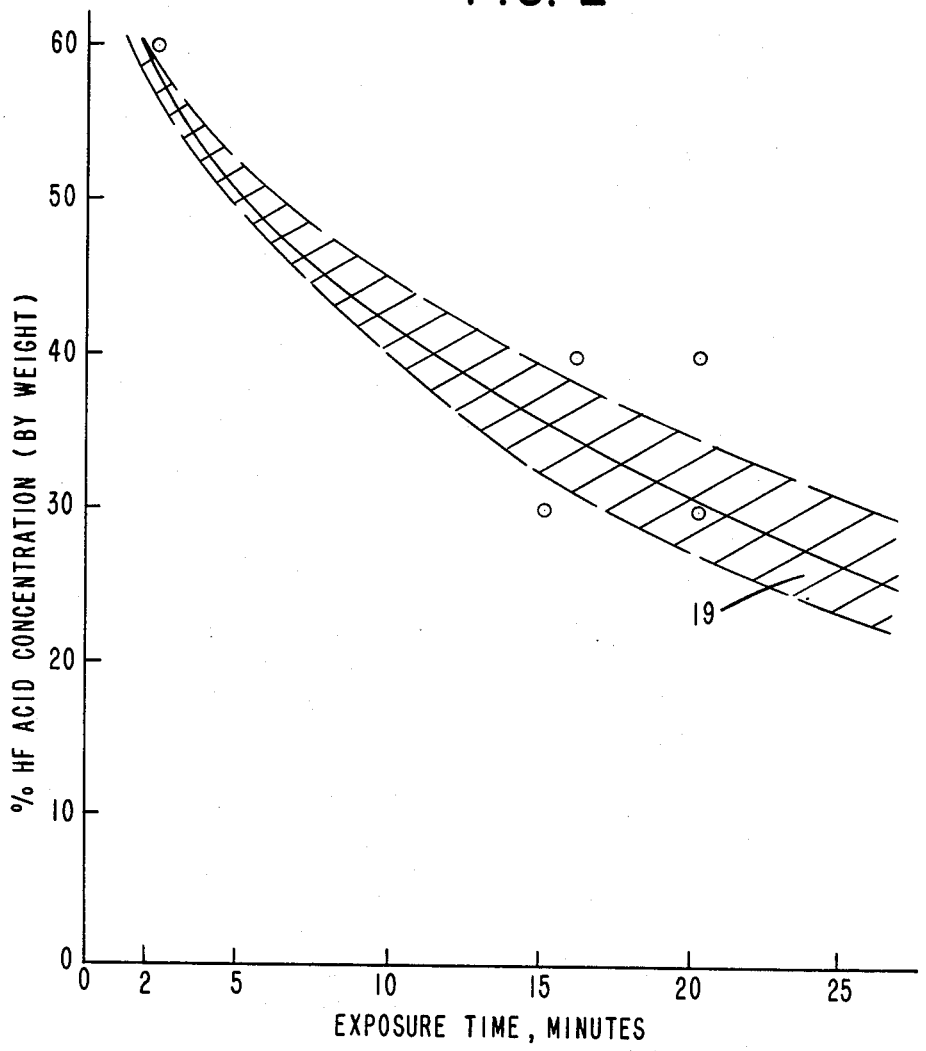
FIG. 2 shows a graph expressing a suitable relationship of parameters for the cleaning process which is a part of this invention.

FIG. 2 shows a graph expressing a suitable relationship for the cleaning step parameters in respect to "Pyrex" glass. The shaded area 19 of the graph depicts an appropriate relationship between acid strength and exposure time for the cleaning step in connection with a "Pyrex" glass workpiece.

For cleaning "Pyrex" glass, it is presently preferred that the cleaning step utilizes an aqueous hydrofluoric acid solution containing about 30–40% hydrofluoric acid by weight, where the exposure time is for a period of about 15–20 minutes during which the cleaning step is performed. To minimize the degree of etching and the dangers inherent in handling acid of this type, an aqueous solution containing about 30% hydrofluoric acid by weight applied for a period of about 15–20 minutes strikes the most preferred balance. A 25% HF solution applied for about 15 minutes was found to impart insufficient wetting properties to "Pyrex" glass, as was a 30% solution applied for about 10 minutes. It may be noted that 30% HF solution applied for more than 20 minutes produced visible etching.

A 25% HF solution and weaker solutions may be applied for periods of more than 20 minutes at the expense of time it takes to perform the cleaning process. Time may be shortened, for example, by using a 60% HF solution for about 2 minutes.

It should be appreciated that one set of acid solution strengths and exposure times are applicable to "Pyrex" glass, and that different combinations of such parameters may be more appropriate to cleaning other types of glass. For example, in cleaning a leaded glass composition, a 30% HF solution was applied for about 5 minutes and was found to produce excessive etching.

After the cleaning step, the nozzle 10 should be thoroughly rinsed to remove the hydrofluoric acid solution from the cleaned surface areas of the nozzle 10. For the rinsing step, degassed distilled water may be used to flush the nozzle 10 and remove the hydrofluoric acid solution. For this purpose, an aspirator device may be used to draw the distilled water through the channel 12 of the nozzle 10.

After rinsing, the interior surface area 16 of the nozzle 10 is coated or covered with a blocking agent to prevent air from contacting the area 16 prior to use of the nozzle 10 in a printer device. The blocking agent should be miscible and chemically compatible with ink jet inks, and should have low volatility where the nozzle is to be stored in environments with gaseous phases present. Suitable blocking agents include ethylene glycol, glycerine (glycerol), or distilled degassed water. Ethylene glycol or glycerine may be used in neat form or in aqueous solution. For example, aqueous solutions containing 75%–90% ethylene glycol by weight are suitable blocking agents. An aqueous solution containing about 85% ethylene glycol by weight is presently preferred for its similarity to the base composition used in a wide number of inks for ink jet printing. Under 100% relative humidity storage conditions, as where the storage environment is a liquid phase, degassed distilled water may be used. Liquids which should not be used in a glass nozzle include oils, e.g. vegetable, mineral, silicone or lubricating oils, and other liquids with non-wetting properties.

For storage prior to use, the nozzle 10 is preferably filled with blocking agent and stored with each end of the nozzle 10 being capped, or the nozzle 10 may be stored in a sealed container. The storage container may be filled with the blocking agent composition to provide a liquid phase storage environment for the nozzle 10, or the storage container may have small amounts of atmospheric or gaseous phases present in which case the nozzle 10 should be pre-filled with a blocking agent having low volatility, such as an aqueous solution wherein the solute is 85% ethylene glycol by weight.

The blocking agent may be applied to the surface area 16 of the nozzle 10 by filling the nozzle 10 with blocking agent by using an aspirator device, or alternatively by using a syringe.

In the practice of this invention, it is preferred that the exterior end face 20 surrounding the orifice 14 should have the property of being unwettable by the ink. This is to prevent degradation of performance due to accumulation of ink on the end face 20 during service. The end face 20 should therefore not be polished, as by fire polishing, and preferably it should be roughened to a ground glass or matte finish by use of fine grit. In this connection, it should be recognized that the desired non-wettability of the end face 20 may be impaired by the previously described cleaning step, depending upon how the hydrofluoric acid solution is administered. By cleaning as shown in FIG. 1 and in a careful manner, the end face 20 may be kept free of contact by the acid cleaning solution. However, if the HF cleaning solution does come into contact with the end face 20, it is necessary only to rinse the end face 20 with distilled water and then allow it to be exposed to the atmosphere for normal contamination to occur. It may take a period of several days to several weeks for this contamination to occur, and to produce the desired non-wetting surface for the end face 20.

Figure 3A:
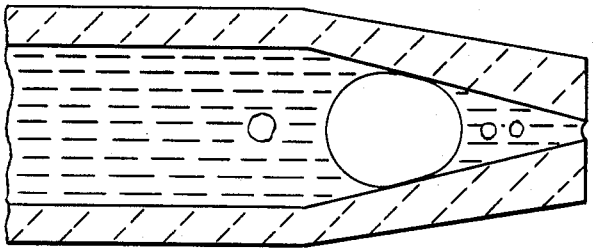
FIGS. 3A–3D show sectional views of glass ink jet nozzles illustrating effects of wetting properties of interior surface areas of the nozzles.
Figure 3B:
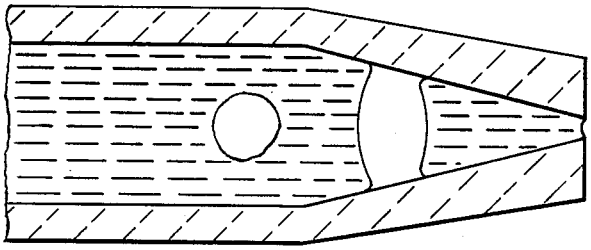
Figure 3C:
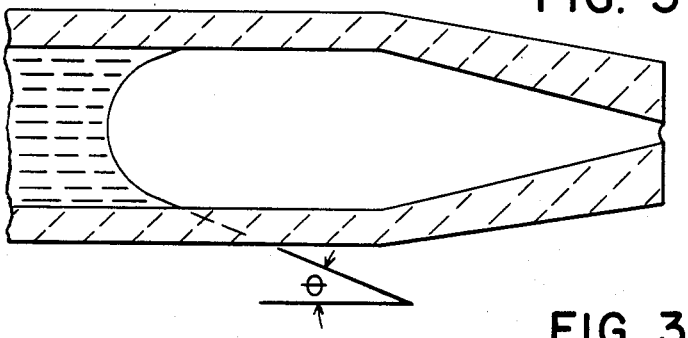
Figure 3D:
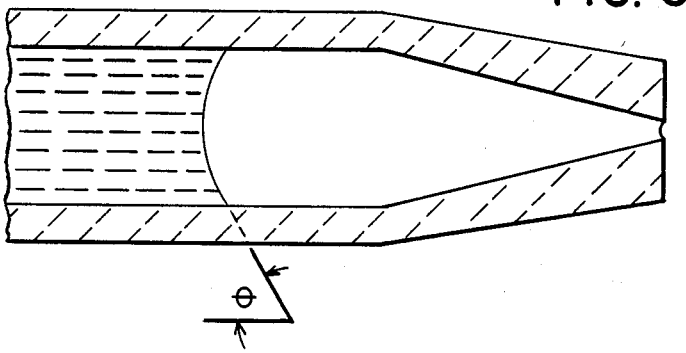

FIGS. 3A–3D illustrate effects of wetting properties of interior surface areas 16 in glass ink jet nozzles 10. FIGS. 3A and 3C are illustrations of the surface areas 16 being wettable by the ink jet ink, whereas FIGS. 3B and 3D are illustrative of where the surface areas 16 are non-wettable by the ink. FIG. 3A shows how air bubbles will not conform to the interior geometry of the nozzle 10, but will have a tendency to conform essentially to a spherical configuration. Air bubbles would be easily purged from the nozzle 10 shown in FIG. 3A. FIG. 3B shows how air bubbles adjacent to a contaminated (or non-wetting) glass surface will tend to conform to the inside geometry of the nozzle 10 and adhere to the surface 16 so as to be resistant to purging. FIGS. 3C and 3D show differences in contact angle theta ($\theta$) at glass-air interfaces within channels 12 of the nozzles 10 having wetting and non-wetting inside surface areas 16, respectively.

As an aid to further understanding of this invention, the following examples are presented.

EXAMPLE 1

Using microscopic slides made of "Pyrex" glass, it was determined that an aqueous solution of 30% hydrofluoric acid by weight applied for 15 minutes rendered the glass surface very wettable. Three drops of distilled water placed on portions of the slides treated with the acid tended to spread thin and cover the treated areas. On the untreated portions, the three drops remained as discrete drops. Although it became somewhat degraded with time, the wetting characteristic produced by the acid remained superior to that for the untreated portions of the slides for a period of several days after the treatment was administered. However, when blocking agent was applied as a coating to the treated portions of the glass slides just after treatment, it provided protection of the treated areas from atmospheric contamination and caused them to retain the wetting characteristics originally imparted by the acid cleaning treatment. The blocking agent was an aqueous solution which contained 85% ethylene glycol by weight.

EXAMPLE 2

"Pyrex" glass was cleaned by a vapor degreasing procedure using iso-propyl alcohol (propynol) in one case, and by a flushing procedure using alkyline solutions (sodium hydroxide and potassium hydroxide) in other cases. In each instance, the glass specimens did not attain the wettability produced in Example 1.

While a number of specific embodiments of this invention have been described in detail herein, it should be understood that the invention may be embodied in still other and various forms. It is intended and is to be understood that the invention is to be defined and limited only by the scope of the following claims.

What is claimed is:

1. A process for decreasing or eliminating air bubble lock in an ink passage through a glass ink jet nozzle usable in an ink jet printer device, said process comprising the following steps:

(a) cleaning the interior area of said ink passage through said glass ink jet nozzle with a hydrofluoric acid solution so as to remove impurities and contaminants from said surface area;

(b) rinsing said ink passage to remove said hydrofluoric acid solution from said surface area before visible etching of said surface area occurs; and (c) introducing and continuously maintaining a blocking agent in said ink passage prior to the use of said nozzle in an ink jet printer device to prevent atmospheric air from contaminating the surface area of said ink passage, wherein said blocking agent is miscible and chemically compatible with ink to be conducted through said ink passage during the use of said ink jet nozzle in ink jet printing.

2. The process of claim 1 wherein said hydrofluoric acid solution of step (a) is an aqueous hydrofluoric acid solution containing about 30–40% hydrofluoric acid by weight.

3. The process of claim 2 wherein said step (a) has a duration of about 15–20 minutes.

4. The process of claim 1 wherein the rinsing of step (b) includes rinsing with degassed distilled water.

5. The process of claim 1 wherein the blocking agent of step (c) is selected from the group consisting of ethylene glycol, glycerine and degassed distilled water.

6. The process of claim 1 wherein the blocking agent of step (c) is an aqueous solution containing 75–90% ethylene glycol by weight.

7. The process of claim 1 wherein said blocking agent is continuously maintained in said ink passage in step (c) by end caps which prevent the introduction of atmospheric air into said ink passage before the use of said ink jet nozzle in an ink jet printer.

8. The process of claim 1 wherein said blocking agent is continuously maintained in said ink passage in step (c) by storing said ink jet nozzle in a sealed container filled with an aqueous solution of 85% ethylene glycol by weight thereby preventing the introduction of atmospheric air into said ink passage before the use of said ink jet nozzle in an ink jet printer.

* * * * *